US007748697B2

(12) United States Patent
Fujita et al.

(10) Patent No.: US 7,748,697 B2
(45) Date of Patent: Jul. 6, 2010

(54) SHEET FEEDING APPARATUS AND IMAGE FORMING APPARATUS

(75) Inventors: Takashi Fujita, Kashiwa (JP); Hiroaki Takagishi, Tokyo (JP); Nobuto Kamiyama, Kashiwa (JP); Kozo Inoue, Toride (JP); Seiichiro Kameda, Abiko (JP); Junichi Moteki, Abiko (JP); Satohisa Tateishi, Abiko (JP); Youichi Chikugo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 11/936,399

(22) Filed: Nov. 7, 2007

(65) Prior Publication Data

US 2008/0111297 A1 May 15, 2008

(30) Foreign Application Priority Data

Nov. 15, 2006 (JP) ..... 2006-308799

(51) Int. Cl.
*B65H 3/40* (2006.01)
*B65H 7/02* (2006.01)
*B65H 9/14* (2006.01)

(52) U.S. Cl. ..... 271/91; 271/95; 271/227; 271/228; 271/231

(58) Field of Classification Search ..... 271/227, 271/228, 231, 91, 95, 13; 399/395
See application file for complete search history.

(56) References Cited

U.S. PATENT DOCUMENTS

| | | | | |
|---|---|---|---|---|
| 5,052,675 | A * | 10/1991 | Shehata et al. | 271/98 |
| 5,156,391 | A | 10/1992 | Roller | 271/227 |
| 5,887,996 | A * | 3/1999 | Castelli et al. | 400/579 |
| 6,272,307 | B1 | 8/2001 | Ishizuka et al. | 399/325 |
| 6,273,418 | B1 | 8/2001 | Fujikura et al. | 271/228 |
| 6,398,214 | B1 | 6/2002 | Moteki et al. | 271/220 |
| 6,409,043 | B1 | 6/2002 | Fujita et al. | 221/10.03 |
| 6,473,579 | B1 | 10/2002 | Suzuki et al. | 399/124 |
| 6,487,381 | B1 | 11/2002 | Ishizuka et al. | 399/67 |
| 6,577,838 | B2 | 6/2003 | Fujita et al. | 399/325 |
| 6,691,399 | B1 | 2/2004 | Hayashi et al. | 29/605 |
| 6,771,928 | B2 | 8/2004 | Fujita | 399/394 |
| 6,845,228 | B2 | 1/2005 | Suzuki et al. | 399/407 |
| 7,034,925 | B2 | 4/2006 | Kamiyama et al. | 355/407 |
| 7,107,001 | B2 | 9/2006 | Kameda | 399/328 |
| 7,108,256 | B2 | 9/2006 | Moteki | 270/58.09 |
| 7,127,186 | B2 | 10/2006 | Fujita et al. | 399/45 |
| 2007/0126165 | A1 | 6/2007 | Kawata et al. | 270/37 |
| 2007/0267803 | A1 | 11/2007 | Tateishi et al. | 271/98 |

FOREIGN PATENT DOCUMENTS

| | | |
|---|---|---|
| JP | 5-201587 | 8/1993 |
| JP | 11-189355 | 7/1999 |

* cited by examiner

*Primary Examiner*—David H Bollinger
(74) *Attorney, Agent, or Firm*—Fitzpatrick, Cella, Harper & Scinto

(57) ABSTRACT

A sheet feeding apparatus according to an aspect of the invention includes conveying suction belts which have a function of rotating an adsorbed sheet and a function of conveying the sheet; a suction fan 112 which adsorbs the sheet to the belts; CCDs which detect a position and an skew in a direction orthogonal to a sheet conveying direction while the sheet is adsorbed to the belts; and a control device for driving the belts to rotate the sheet according to signals of CCDs in order to correct an attitude of the sheet adsorbed to the belts.

12 Claims, 12 Drawing Sheets

SHEET FEEDING APPARATUS AND IMAGE FORMING APPARATUS

BACKGROUND OF THE INVENTION

1. Field of the Invention

The present invention relates to a sheet feeding apparatus used in an image forming apparatus such as a printer, a facsimile, a copying machine, and a multi function peripheral having functions thereof.

2. Description of the Related Art

Examples of the image forming apparatus include an electrophotographic system, an offset printing system, and an inkjet printing system. In this case, a color image forming apparatus in which the electrophotographic system is used is cited by way of example to describe the related art.

From the standpoint of configuration, the color image forming apparatus is mainly divided into a tandem type in which plural image forming portions are arranged side by side and a rotary type in which plural image forming portions are arranged in a cylindrical shape. From the standpoint of transfer method, the color image forming apparatus is mainly divided into a direct transfer method for directly transferring a toner image to a sheet from a photosensitive member and an intermediate transfer method in which the toner image is transferred to the sheet after the toner image is tentatively transferred to an intermediate transfer member.

For example, there is an intermediate transfer tandem type of image forming apparatus in which four color image forming portions are arranged side by side on an intermediate transfer belt. Recently in such pieces of electrophotographic apparatus, an image forming apparatus which focuses on a print market of a small amount of circulation by utilizing an advantage that formation of a printing plate is not required unlike a printing machine. However, in order to enter the print market of the small amount of circulation, it is necessary to achieve a high-quality image, and one of factors for the high-quality image focuses on accuracy of an image position with respect to the sheet which is of a transfer material. The demand for a thin sheet of 50 g/m$^2$ or less is enhanced.

Considering improvement of the accuracy of the image position with respect to the sheet, the accuracy of the image position is determined by registration in a sheet conveying direction, the registration in a direction orthogonal to the sheet conveying direction, magnification, and skew feeding. The skew feeding is hardly corrected by electrical control. For example, the sheet skew feeding is detected and the image position with respect to the sheet can be corrected by producing the inclined image according to the skew feeding. However, in a color image in which three or four colors are superposed, when the image is inclined in each color, a tint is changed in each sheet due to shift of dot formation in each color. Additionally it takes along time to compute the inclined image, which causes productivity to be extremely decreased. Therefore, the skew feeding is determined by performance of sheet conveying accuracy.

The method of correcting the sheet skew feeding is mainly divided in the following methods.

(1) A pair of registration rollers is disposed on an upstream side of a transfer portion, a front end of the conveyed sheet abuts on the registration rollers under suspension, and the sheet is pushed into the registration rollers to form a loop, thereby correcting the skew feeding. The registration rollers are restarted in synchronization with the image, which performs the sheet skew feeding correction and image matching in the sheet conveying direction.

(2) Using a retractable shutter instead of the registration rollers, the front end of the conveyed sheet abuts on the shutter to correct the skew feeding. Then, the sheet position is detected the image is formed while aligned with the sheet position, which performs the sheet skew feeding correction and the image matching in the sheet conveying direction.

(3) The sheet is conveyed by a skew roller while abutting on a regulating plate provided along the sheet conveying direction, the sheet skew feeding is corrected, the front end of the sheet is detected, and the image position alignment in the sheet conveying direction is performed by controlling a sheet speed (see Japanese Patent Application Laid-Open No. 11-189355).

(4) Means for detecting the skew feeding and two rollers independently driven in the direction orthogonal to the sheet conveying direction are provided, and a sheet conveying speed is changed to rotate the sheet according to an amount of sheet skew feeding, thereby correcting the skew feeding (see Japanese Patent Application Laid-Open No. 5-201587).

However, in the methods (1) to (3), because the skew feeding is corrected by utilizing stiffness (elasticity) of the sheet as the transfer material, a sufficient effect is not exerted for the thin sheet having low stiffness. On the other hand, in the method (4), because the skew feeding can be corrected without utilizing the sheet stiffness, the effect is exerted for the thin sheet having low stiffness.

However, because the correction is predictive control after the sheet skew feeding is detected in the method (4), the skew feeding detection error has a direct affect on the correction result. Therefore, the skew feeding may not completely be corrected.

It is necessary to detect the amount of skew feeding during the conveyance. One of the factors for the generation of the skew feeding detection error is a detection error due to a decrease in detection accuracy caused by an influence of speed of the detection device. Guide conveying resistance easily has an influence on the thin sheet, and an attitude of the sheet is not stabilized during the conveyance, which causes the unstable detection result of the skew feeding.

In view of the foregoing, an object of the invention is to provide a sheet feeding apparatus which can accurately correct the skew feeding to the sheet having low stiffness, and an image forming apparatus in which the sheet feeding apparatus is used.

SUMMARY OF THE INVENTION

In accordance with an aspect of the invention, a sheet feeding apparatus comprising:

a sheet supporting portion configured to support the sheets;

a sheet conveying device disposed above the sheet supporting portion configured to absorb and to convey the sheet;

a suction device configured to absorb the sheet from the sheet supporting portion to the sheet conveying device; and a detection device configured to detect a skew of the sheet adsorbed to the sheet conveying device by the suction device, wherein the sheet conveying device has a function of rotating the sheet absorbed to the sheet conveying device to correct the skew of the sheet based on the detection of the detection device.

DESCRIPTION OF THE EMBODIMENTS

First Embodiment

Figure 1:
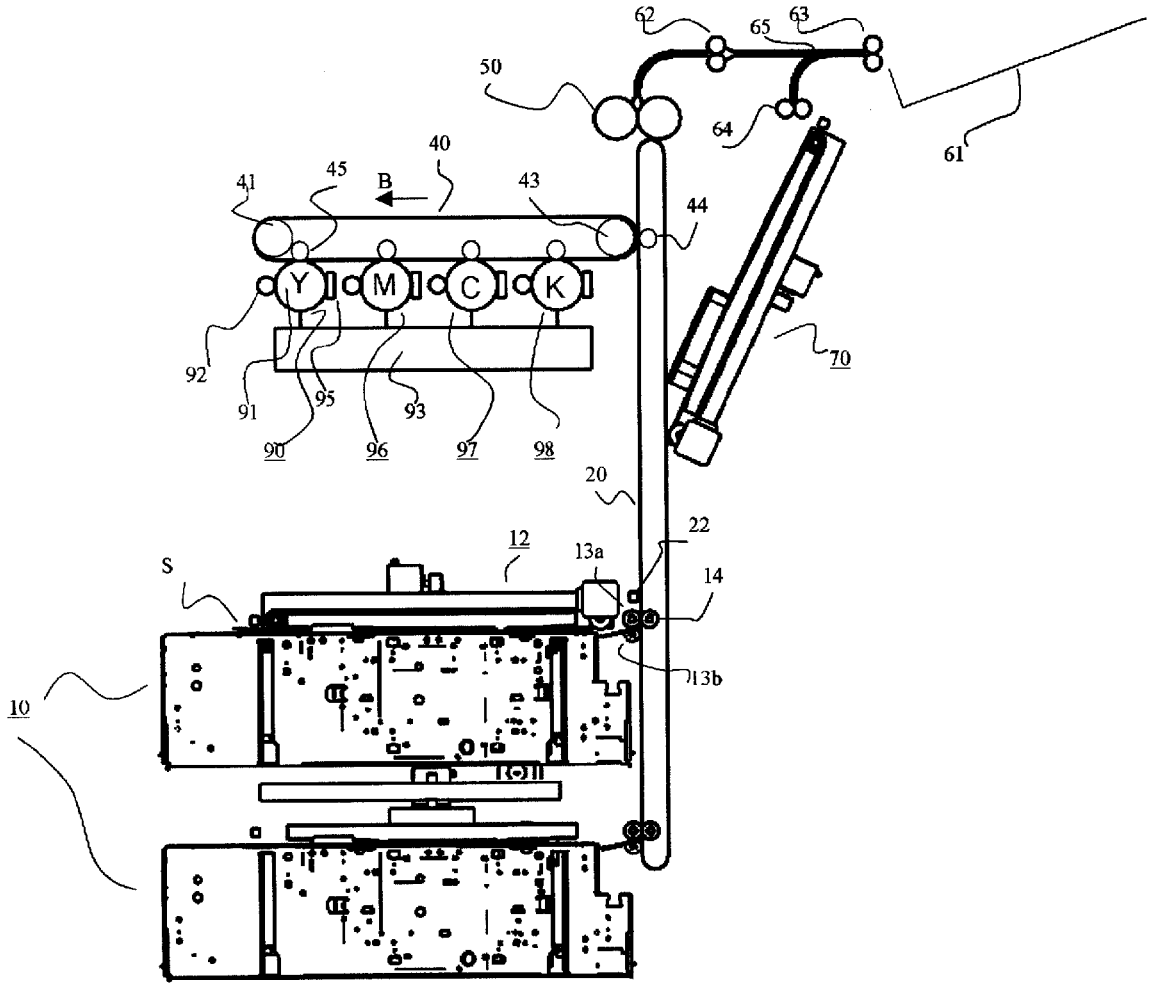
FIG. 1 is a front view showing an entire image forming apparatus according to a first embodiment of the invention.

An image forming apparatus in which a sheet feeding apparatus according to a first embodiment of the invention will be described with reference to the drawings.

[Entire Configuration of Image Forming Apparatus]

An entire configuration of the image forming apparatus of the first embodiment will schematically be described with reference to FIGS. 1 and 2.

In the image forming apparatus of the first embodiment, using an image forming portion including a transfer device, an image is formed by transferring a toner image to a sheet S which is of a transfer material fed by a sheet feeding apparatus 10.

The sheet S which is of the transfer material is stacked and supported on a lift-up device 11 which is of a sheet supporting portion included in the sheet feeding apparatus 10, and the sheet S is fed by a sheet feeding apparatus 12. The sheet S fed by the sheet feeding apparatus 12 is delivered to a conveying belt 20 while nipped between a pair of conveying rollers 13*a* and 13*b*. An adsorption roller 14 is disposed across the conveying belt 20 from the conveying roller 13*a*, whereby the sheet S is electrostatically adsorbed to the conveying belt 20 by applying a bias voltage (not shown). The conveying belt 20 is made of a polyamide-imide resin, and the conveying belt 20 is formed in an endless belt shape. In the conveying roller 13*a* and the adsorption roller 14, conductive rubber is bonded to a surface layer of a metal cored bar. A surface layer of the conveying roller 13*b* is made of an insulating resin such as polyacetal such that a bias current does not flow into the conveying roller 13*b*.

The sheet S adsorbed onto the conveying belt 20 is delivered to a secondary transfer portion. The secondary transfer portion includes a secondary transfer inner roller 43 and a secondary transfer outer roller 44, which substantially face each other. A predetermined pressing force and a predetermined electrostatic load bias are imparted to transfer the unfixed image to the sheet S at a toner image transfer nip portion formed between the secondary transfer inner roller 43 and the secondary transfer outer roller 44.

Thus, the sheet S is conveyed to the secondary transfer portion in the above-described process. Then, a process of forming the image delivered to the secondary transfer portion at similar timing will be described.

An image forming portion 90 constituting the image forming portion mainly includes a photosensitive drum 91, an exposure device 93, a development device 92, a primary transfer roller 45, and a photosensitive member cleaner 95. The photosensitive drum 91 is rotated counterclockwise while a surface of the photosensitive drum 91 is previously evenly charged by a charging device. The exposure device 93 emits light based on a transmitted image information signal, and the surface of the photosensitive drum 91 is irradiated with the light through reflection device to form an electrostatic latent image on the photosensitive drum 91. The electrostatic latent image formed on the photosensitive drum 91 is toner-developed to form a toner image on a photosensitive member by the development device 92. Then, the primary transfer roller 45 imparts the pressing force and electrostatic load bias to transfer the toner image onto an intermediate transfer belt (image bearing member) 40. Then, a small amount of residual transfer toner remaining on the photosensitive drum 91 is recovered to prepare the next image formation by the photosensitive member cleaner 95.

Figure 2:
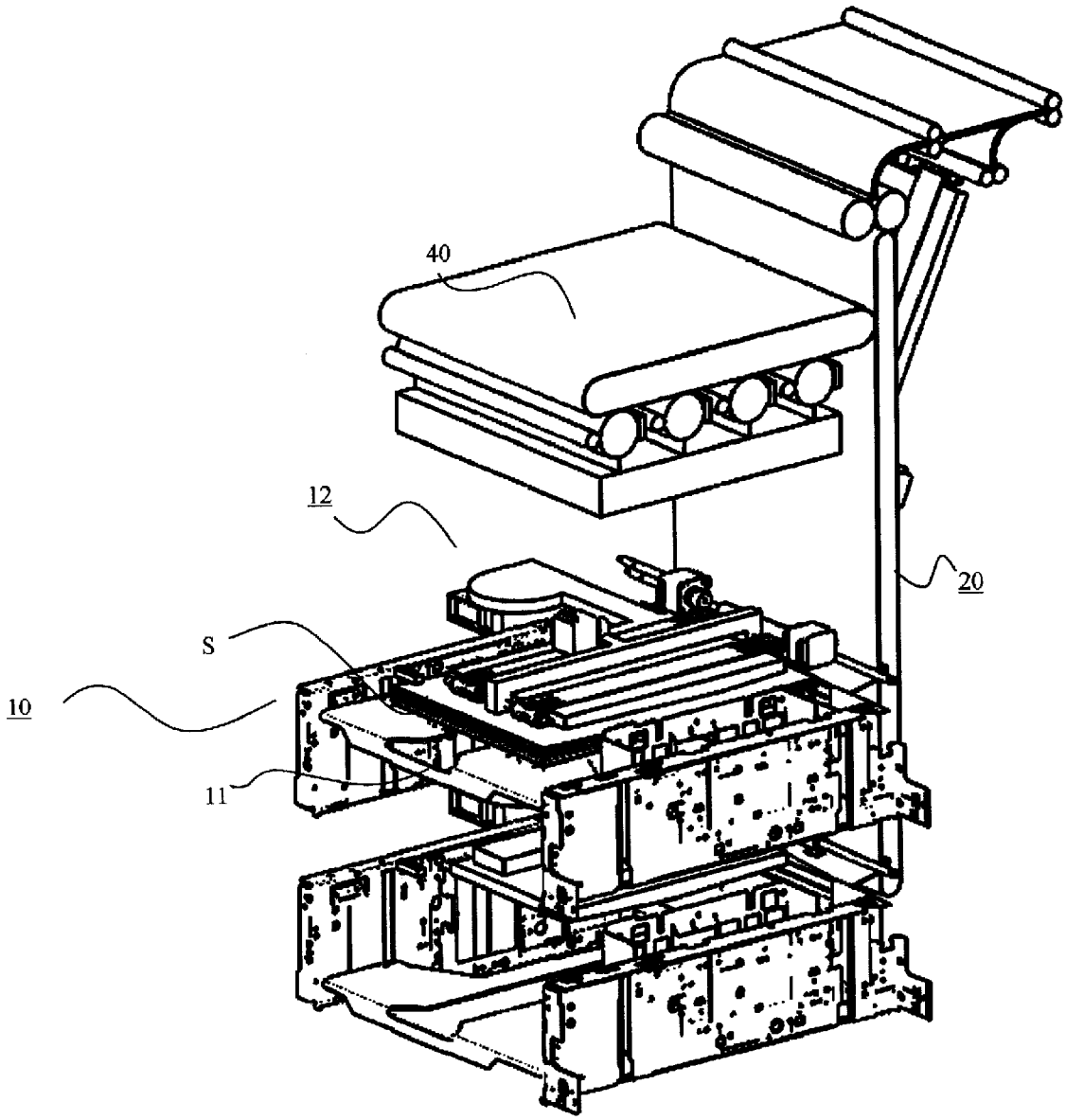
FIG. 2 is a perspective view showing the entire apparatus of the first embodiment.

The image forming portion of FIG. 1 includes four image forming portions 90, 96, 97, and 98 which form toner images of yellow (Y), magenta (M), cyan (C), and black (K) colors respectively. Obviously the toner images are not limited to the four colors, and the order of color is not limited to the image forming portion of FIG. 1.

The intermediate transfer belt 40 is entrained about rollers such as a tension roller 41 and the secondary transfer inner roller 43, and the intermediate transfer belt 40 is conveyed and driven toward a direction shown by an arrow B of FIG. 1. Accordingly, the image forming processes which are concurrently performed by the pieces of image forming apparatus of the yellow (Y), magenta (M), cyan (C), and black (K) are performed at the time the toner image is superposed on the upstream toner image primary-transferred onto the intermediate transfer belt 40. As a result, finally the full-color toner image is formed on the intermediate transfer belt 40 and conveyed to the secondary transfer portion (transfer device).

Thus, the full-color toner image is secondary-transferred onto the sheet S in the secondary transfer portion through the sheet conveying process and the image forming process. Then, the sheet S is conveyed to a fixing device 50 by the conveying belt 20. The fixing device 50 melts and fixes the toner onto the sheet using a predetermined pressing force generated by the substantially-facing rollers or the belt and heating effect generated by a heat source such as a halogen heater. The sheet S having the fixed image obtained in the above-described manner passes through conveying rollers 62 and 63, and the sheet S is discharged on a discharge tray 61.

In the case where the duplex image formation is required, the conveying rollers 63 are reversely rotated at predetermined timing, and the sheet S is conveyed to conveying rollers 64 by a duplex flexible flapper 65.

In the duplex image formation, the sheet S is delivered from the duplex conveying rollers 64 to a duplex feeding device 70. The duplex feeding device 70 has the same configuration as the sheet feeding apparatus 12, and the sheet feeding apparatus will be described in detail later. The duplex feeding device 70 feeds the sheet S to the conveying belt 20 at predetermined timing, the sheet S is adsorbed to conveying belt 20 by a bias device (not shown), and the image is transferred again in the secondary transfer portion.

[Sheet Feeding Apparatus]

Figure 3:
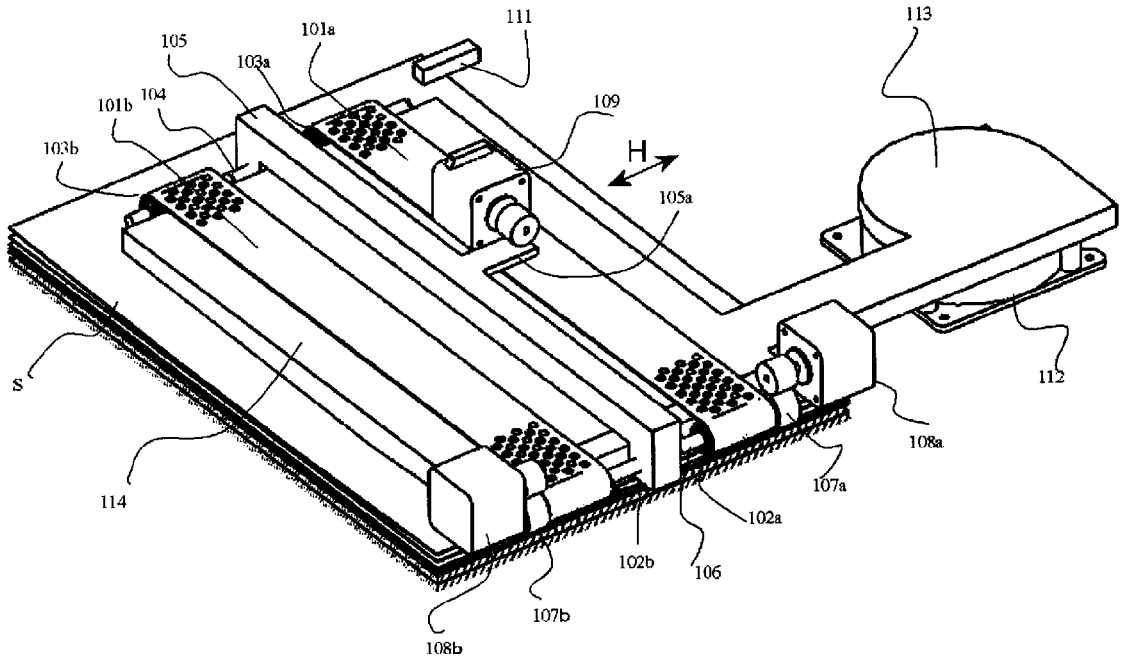
FIG. 3 is a perspective view showing a sheet feeding apparatus of the first embodiment.
Figure 4:
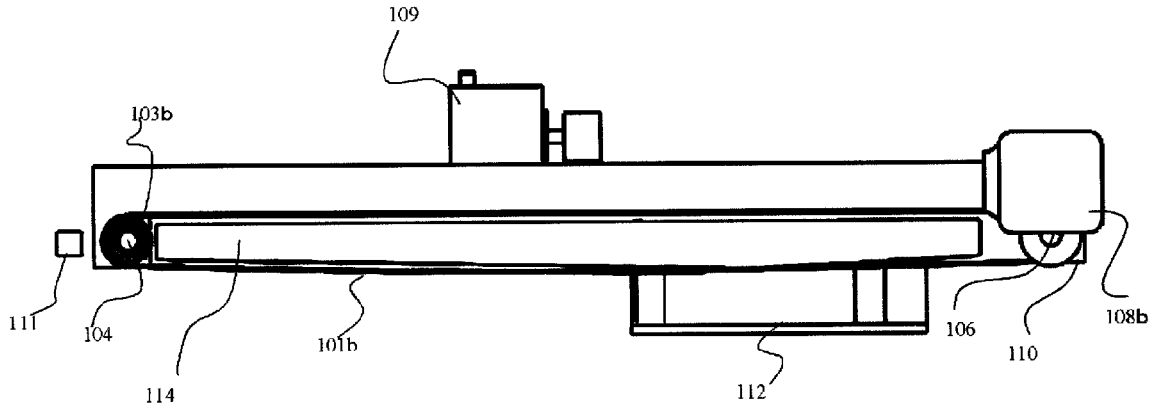
FIG. 4 is a front view showing the sheet feeding apparatus of the first embodiment.
Figure 5:
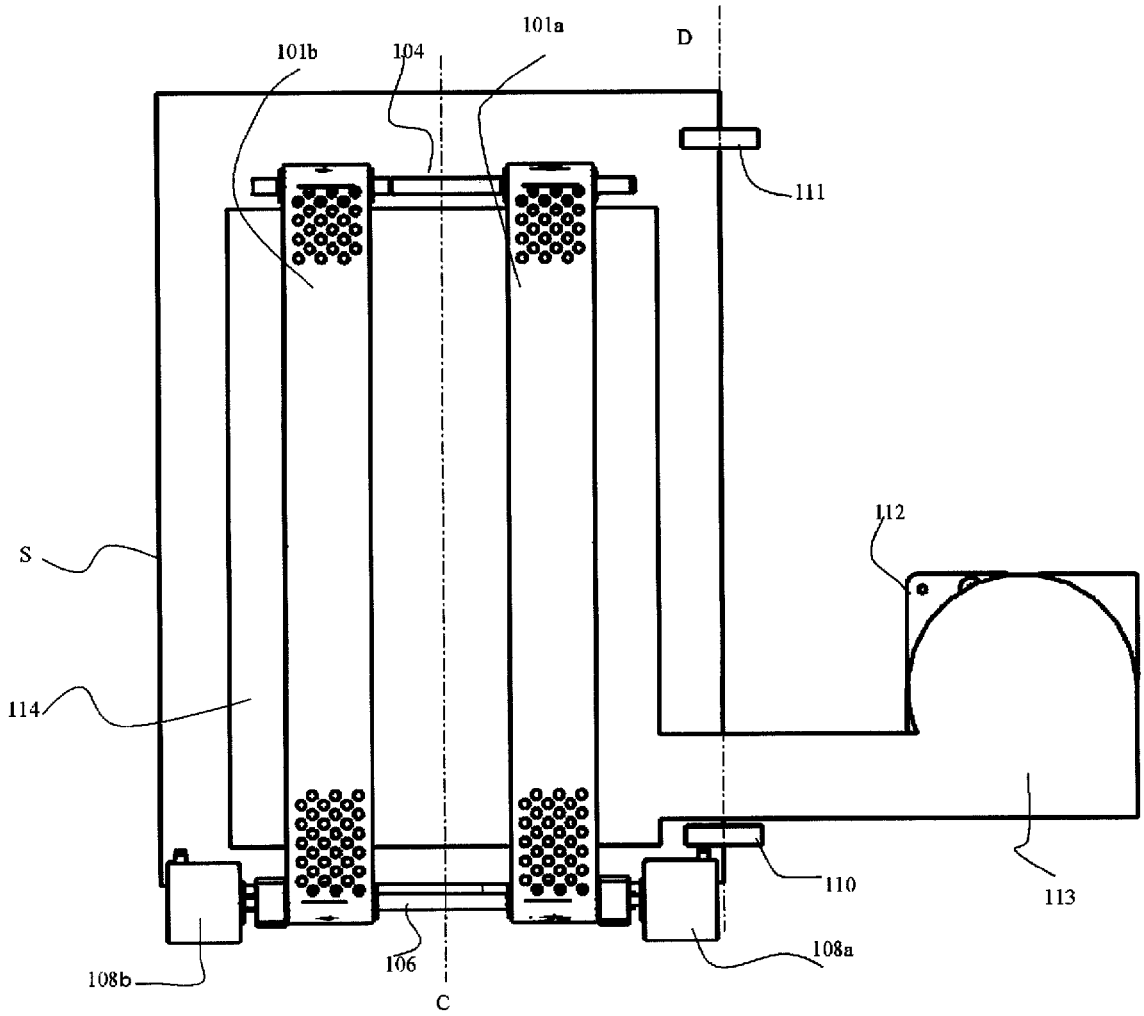
FIG. 5 is a top view showing the sheet feeding apparatus of the first embodiment.

Then, the sheet feeding apparatus 10 will be described. FIG. 3 is a perspective view showing the whole of the sheet feeding apparatus 12, FIG. 4 is a front view of the sheet feeding apparatus 12, and FIG. 5 is a top view of the sheet feeding apparatus 12.

The sheet conveying device has conveying suction belts 101*a* and 101*b* above the lift-up device 11. The conveying suction belts 101*a* and 101*b* are symmetrically disposed at two points in relation to a center C in a width direction (orthogonal to the sheet conveying direction) of the sheet S. The conveying suction belts 101*a* and 101*b* are the rotatable endless belts which are of the sheet conveying device of the first embodiment. The conveying suction belts 101*a* and 101*b* are entrained about driving pulleys 102*a* and 102*b* and driven pulleys 103*a* and 103*b* respectively, and the conveying suction belts 101*a* and 101*b* can be rotated in the sheet conveying direction and the opposite direction to the sheet conveying direction. The sheet conveying device has both a function of rotating the sheet in a plane including an adsorption surface (in a plane including sheet surface) while the sheet is adsorbed by the conveying suction belts 101*a* and 101*b* and a function of rotating the conveying suction belts 101*a* and 101*b* to convey the sheet. The conveying suction belts 101*a* and 101*b* made of rubber such as EPDM, and many holes are made in the surfaces of the conveying suction belts 101*a* and 101*b*. The pulleys 102*a*, 102*b*, 103*a*, and 103*b* are made of resin and formed in a crowned shape. Therefore, because the conveying suction belts 101*a* and 101*b* are rotated and self-aligned, the conveying suction belts 101*a* and 101*b* are not disengaged from the pulleys 102*a*, 102*b*, 103*a*, and 103*b*. The driven pulleys 103*a* and 103*b* is rotatably supported by a shaft 104 fixed to a stay 105.

Similarly the driving pulleys 102*a* and 102*b* is rotatably supported by a shaft 106 fixed to the stay 105. Each of gears 107*a* and 107*b* is coupled to one end of each of the driving pulleys 102*a* and 102*b*, whereby the rotations of the driving pulleys 102*a* and 102*b* can independently be controlled by belt driving motors 108*a* and 108*b* which are of stepping motors.

A moving device which move the sheet conveying device in the direction orthogonal to the sheet conveying direction will be described below. The stay 105 is supported by a guide device (not shown) while being movable in the direction orthogonal to the sheet conveying direction. A rack 105*a* is formed in a part of the stay 105 to engage a belt slide motor 109 which is of the stepping motor. The conveying suction belts 101*a* and 101*b* is slidable in the direction shown by an arrow H (direction orthogonal to the sheet conveying direction) by the belt slide motor 109 and a gear head thereof while the stay 105 is interposed.

A suction head portion which is of a suction device for sucking the sheet to the sheet conveying device of the first embodiment will be described below. A suction head 114 is coupled to a duct 113 by a suction fan 112, an opening is provided in a lower surface of a portion corresponding to the conveying suction belt 101 (101*a* and 101*b*), and the sheet is sucked through the holes in the conveying suction belt 101. Therefore, the uppermost sheet S can be conveyed while sucked by the conveying suction belt 101.

Although not described in the first embodiment, a front end of the stacked sheets S may be blown with separation air from a front side in the conveying direction to increase separation efficiency of the one sheet S from the sheet bundle. As shown in FIG. 4, a lower portion of the suction head 114 in section, a central portion is projected in a downward direction orthogonal to the sheet conveying direction. Therefore, in a contact surface between the sheet and the conveying suction belts 101*a* and 101*b* rotated along the shape of the suction head 114, the central portion in the sheet conveying direction is projected downward from both end portions in the sheet conveying direction. Consequently, even if the thin sheet having a low stiffness is sucked, the sheet end portion does not hang downward.

CCDs 110 and 111 are disposed above the sheet S at the front-side portion and the rear-side portion in the sheet conveying direction respectively. CCDs 110 and 111 are of a detection device for detecting a position of the end portion in the direction orthogonal to the sheet conveying direction. The skew amount of the sheet is calculated by a control device (described in later) based on the detection of CCDs 110 and 111. In addition, CCDs 110 and 111 have also a function of a position detection device for detecting a position of the sheet in the direction orthogonal to the sheet conveying direction. Detection accuracy is improved in the end portion of the sheet S by preventing the hanging of the sheet end portion in the above-described manner.

(Feeding Control Configuration)

Figure 6:
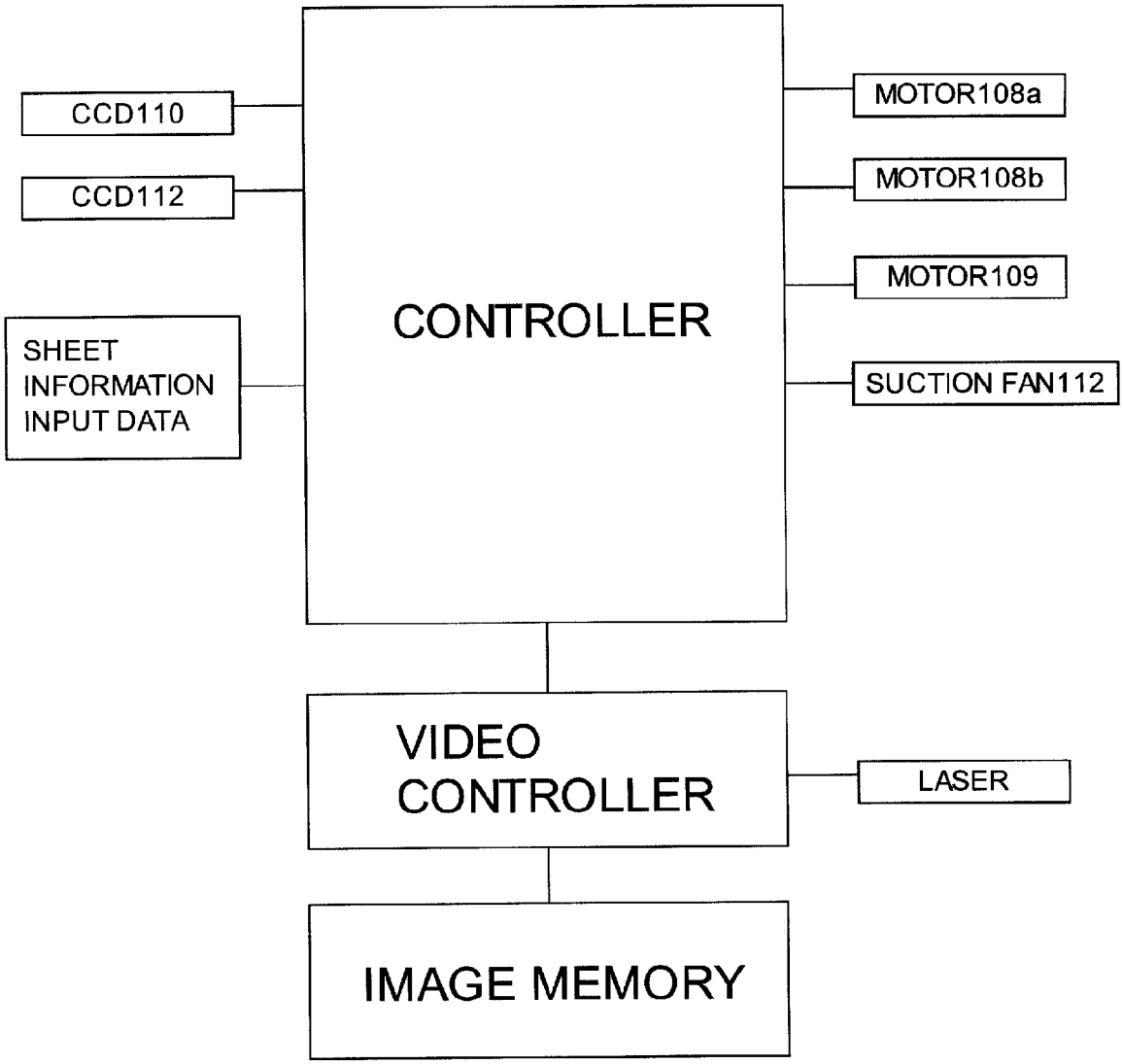
FIG. 6 is a block diagram showing a control configuration of the first embodiment.
Figure 7:
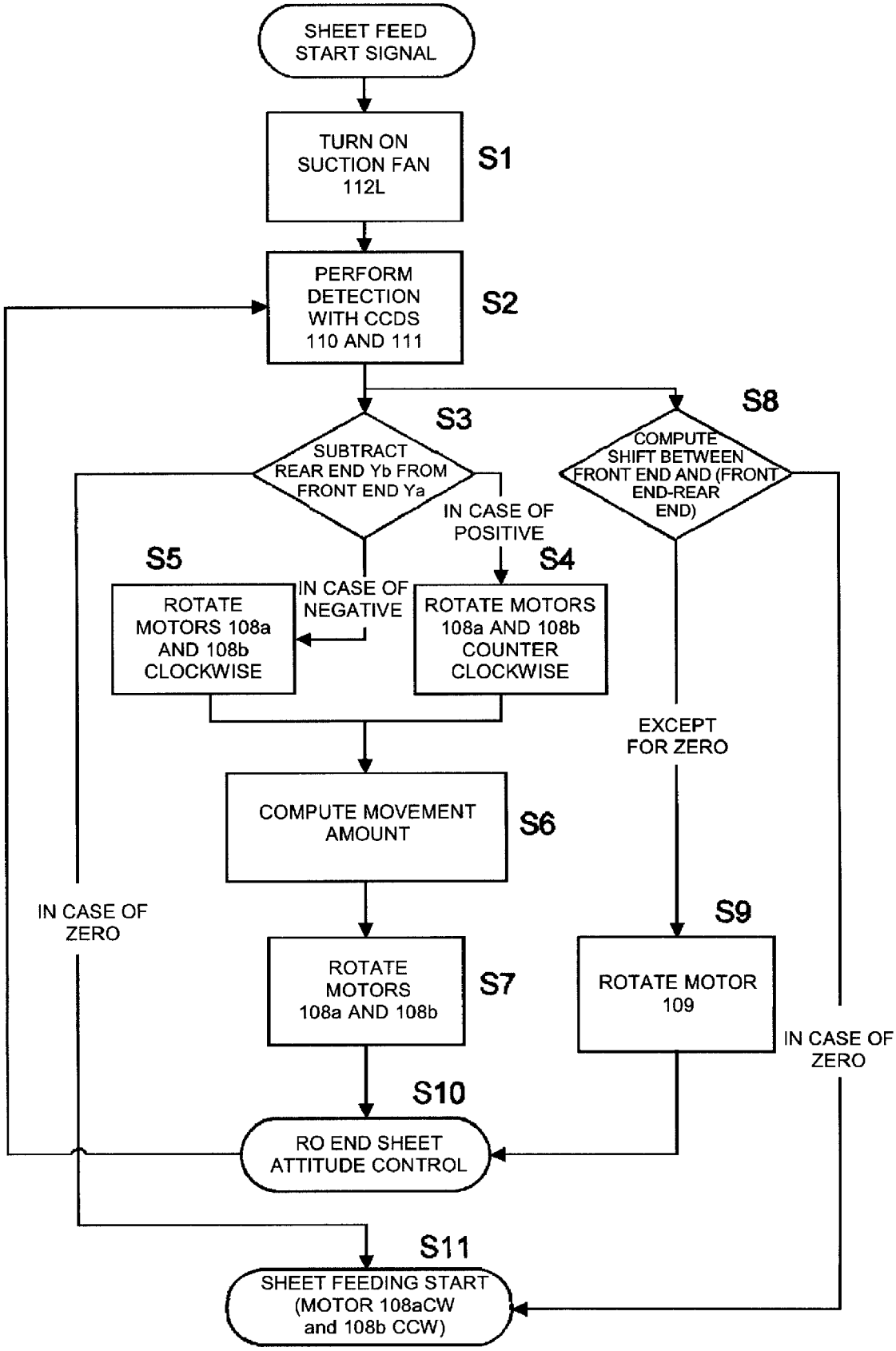
FIG. 7 is a flowchart showing sheet feeding control of the first embodiment.
Figure 8:
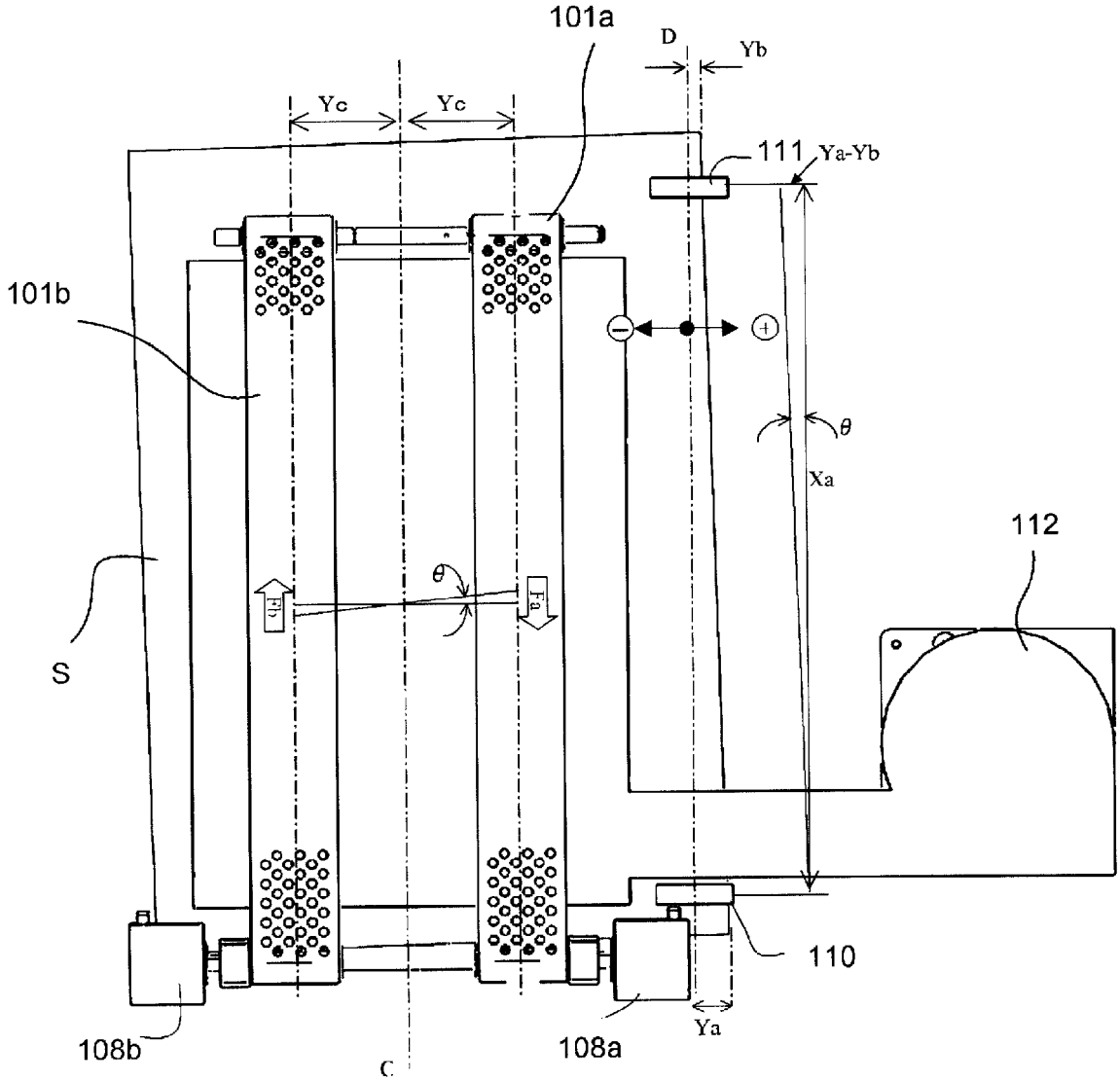
FIG. 8 is a view showing a sheet feeding control state of the first embodiment.
Figure 9:
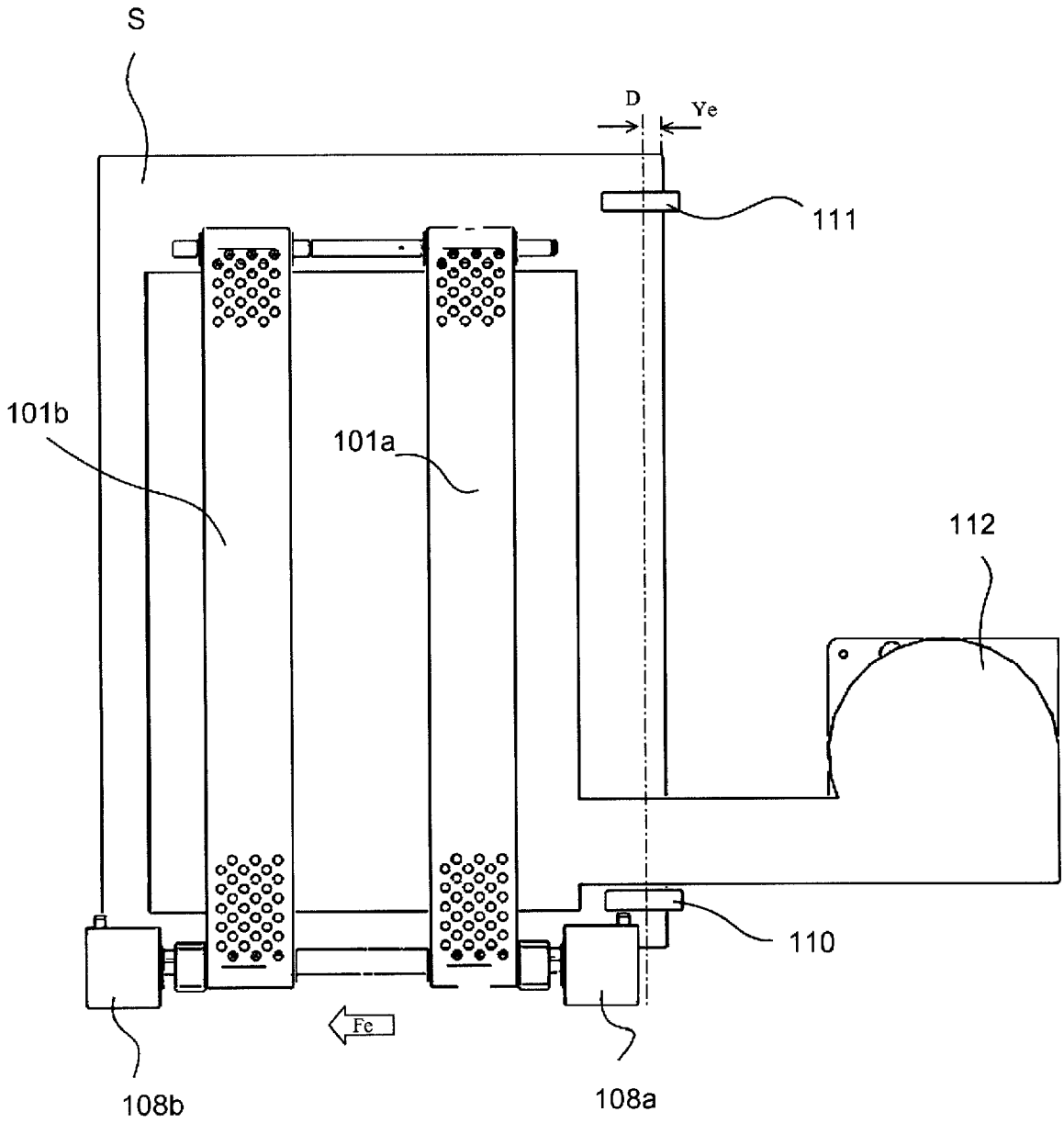
FIG. 9 is a view showing a sheet control state of the first embodiment.
Figure 10:
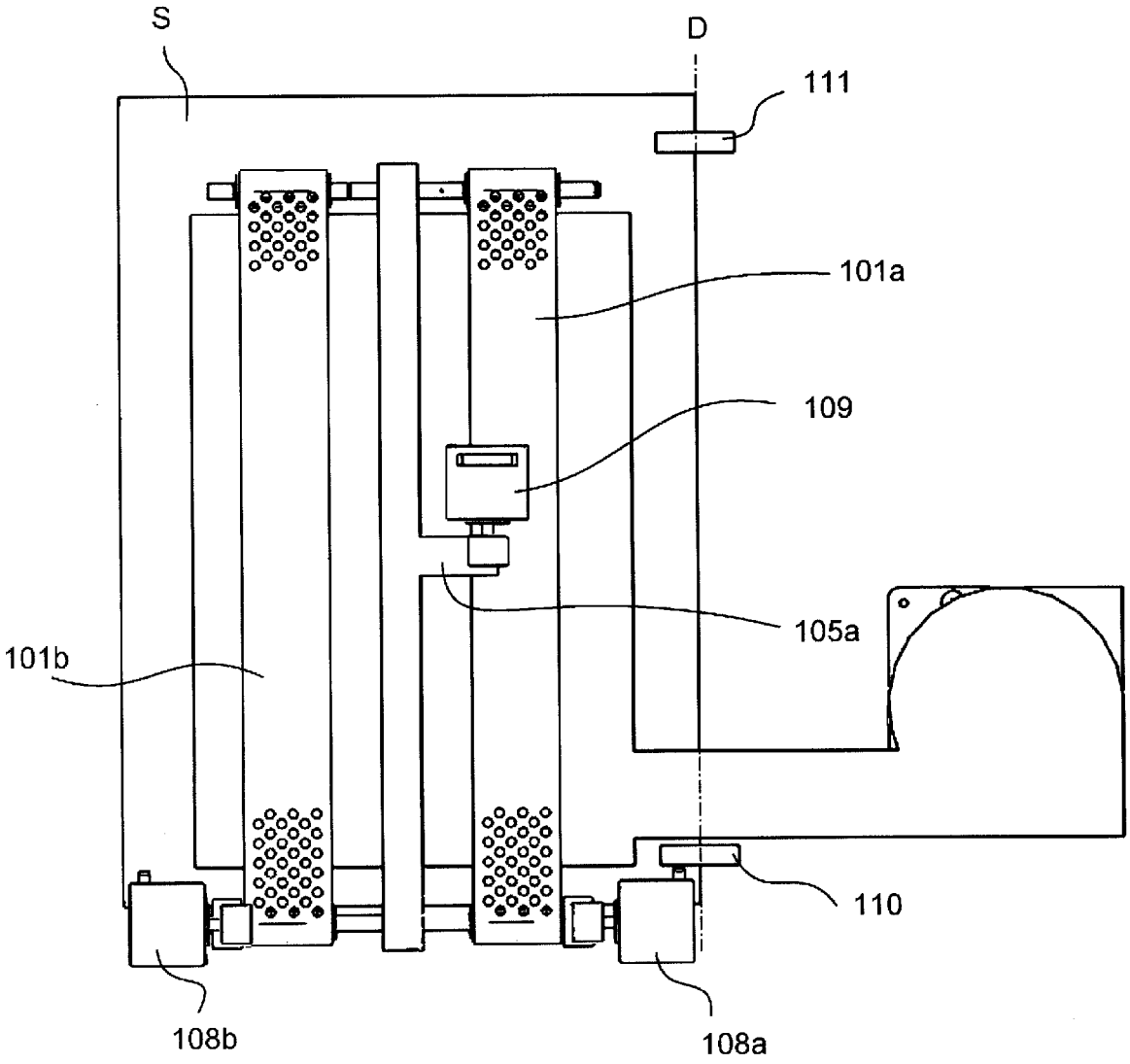
FIG. 10 is a view showing a sheet control state of the first embodiment.

Control in feeding the sheet S will be described with reference to FIGS. 6 to 10. FIG. 6 is a block diagram showing a control configuration of the first embodiment, FIG. 7 is a flowchart showing a control procedure, and FIGS. 8 to 10 are top views for describing an operation of the sheet feeding apparatus 12.

As shown in FIG. 6, a controller which is of control device of the first embodiment controls the motors 108*a*, 108*b*, and 109 and the suction fan 112 based on CCDs 110 and 111 and sheet information such as a sheet kind from a sheet information input device. Therefore, a sheet adsorption force to the conveying suction belts 101*a* and 101*b* is adjusted according to the sheet kind. The control device controls the drives of the conveying suction belts 101*a* and 101*b* according to a detection signal from CCDs 110 and 111, and the control device rotates the sheet in a plane including the adsorption surfaces of the conveying suction belts 101*a* and 101*b*, thereby correcting a skew of the sheet adsorbed to the conveying suction belts 101*a* and 101*b*.

As shown in FIG. 5, in conveying the sheet S, a reference position of the sheet end portion (end portion in the direction orthogonal to the sheet conveying direction) is normally located on a line connecting centerlines D of CCDs 110 and 111. Because CCDs 110 and 111 are aligned with respect to the image forming portion, the sheet S can be conveyed by the conveying belt 20 while the skew feeding is eliminated, when the sheet S is fed in this state of things. However, when the sheet S is adsorbed to the conveying suction belt 101, actually the skew of the sheet and the position shift in the direction orthogonal to the sheet conveyance direction are generated when the sheet S is adsorbed to the conveying suction belt 101 (see FIG. 8).

It is necessary that the sheet feeding be started after the skew of the sheet and the position of the sheet in the direction orthogonal to the sheet conveyance direction are corrected into the normal attitude. Therefore, when a sheet feeding start signal is generated, the suction fan 112 is turned on (S1: step 1), and signals from CCDs 110 and 111 are monitored to detect the sheet attitude (S2: step 2). A difference is extracted when the centers of CCDs 110 and 111 are set to zero, and a value in which a rear-end side Yb(111) is subtracted from a front-end side Ya(110) is computed (S3: step 3).

In the first embodiment, the suction fan side is set to a positive direction (+), and the opposite direction to the suction fan side is set to a negative direction (−). In the example of FIG. 8, the value (Ya-Yb) becomes positive (+) Therefore, the rotation of the motor 108*a* is controlled such that the surface of the conveying suction belt 101*a* which is located on the positive (+) side and brought into contact with the sheet S is moved in a direction shown by an arrow Fa, and the rotation of the motor 108*b* is controlled such that the conveying suction belt 101*b* located on the negative (−) side is moved in the opposite direction shown by an arrow Fb (S4: step 4).

In the case where the value (Ya-Yb) becomes negative (−), the belt driving motors 108*a* and 108*b* are rotated counterclockwise (CCW), and the conveying suction belts 101*a* and 101*b* are rotated while reversing the rotational directions (S5: step 5). Thus, the rotations of the conveying suction belts 101*a* and 101*b* rotate the sheet in the plane (including the sheet surface) including the adsorption surfaces of the conveying suction belts 101*a* and 101*b* while adsorbed to the conveying suction belts 101*a* and 101*b*, which allows the skew of the sheet to be corrected.

Assuming that Xa is a distance between CCDs 110 and 111, a correction amount θis obtained from tan θ=(Ya-Yb)/Xa. Therefore, rotation amounts of belt driving motors 108*a* and 108*b* are determined in terms of a center distance Yc between the unit center and the center of each of the conveying suction belts 101*a* and 101*b*, and the belt driving motors 108*a* and 108*b* are rotated (S6: step 6 and S7: step 7).

In the first embodiment, the belt driving motors 108*a* and 108*b* are equally rotated while reversing the rotational directions in order to quickly perform the attitude control of the sheet S, so that the attitude can be controlled in half the time of the control with only one motor.

As shown in FIG. 9, in order to correct the shift the sheet in the direction orthogonal to the sheet conveying direction by the moving device, the belt slide motor 109 is operated by an amount Ye shifted from the center of CCDs 110 and 111 in the direction of an arrow Fe (S8: step 8 and S9: step 9). As a result, as shown in FIG. 10, the side-edge of the sheet S can be aligned with the center D of CCDs 110 and 111.

The correction of the sheet skew (skew correction) and the correction of the sheet position shift (position shift correction) in the direction orthogonal to the sheet conveying direction are independently described for the purpose of easily describing the operation. However, the skew correction and the position shift correction in the direction orthogonal to the sheet conveying direction may simultaneously be performed to quickly control the attitude. The sheet position shift from the center D of CCDs 110 and 111 is computed from (Ya-Yb)/2, and the position shift correction in the direction orthogonal to the sheet conveying direction can be corrected.

Sometimes the attitude is not corrected one time due to conveying errors of the conveying suction belts 101*a* and 101*b* and the like. Therefore, the pieces of detection data of CCDs 110 and 111 are received again after the attitude control is performed, and loop control is repeatedly performed until the attitude is corrected. In the first embodiment, when the skew correction and the position shift correction in the direction orthogonal to the sheet conveying direction are controlled in the completely independent manner, because the value to be corrected becomes unclear due to control time shift, the skew correction and the position shift correction in the direction orthogonal to the sheet conveying direction are controlled in one.

When the attitude control of the sheet S is completed, sheet feeding is started (S10: step 10 and S11: step 11).

At this point, the sheet feeding cannot be started when the attitude control is not completed. Therefore, when the sheet feeding distance is sufficiently provided, an attitude control time is not influenced to the productivity. When the productivity is improved by shortening the sheet feeding distance, an attitude control time becomes highlighted.

In the first embodiment, a photo sensor 22 that is of a front-end detection device for detecting the front end of the sheet S conveyed by the conveying belt 20 is disposed to achieve the maximum productivity (see FIG. 1). The distance between the photo sensor 22 and transfer device is set such that the transfer the image on the sheet is performed even if the image is written in the uppermost stream photosensitive drum after the front end of the sheet is detected by the photo sensor 22. The start of the image write is controlled by laser output timing using a video controller, and the turn-on and turn-off of the laser are controlled according to the image stored in an image memory. In the first embodiment, the sheet can be conveyed to the transfer device without stopping the sheet because the image forming on the image forming portion can be started based on the detection of the photo sensor 22, so the sheet feeding can be started immediately after the attitude control is completed, so that the maximum productivity can be obtained.

In the first embodiment, the sheet S is adsorbed to the conveying belt 20 immediately after the sheet feeding. Therefore, the buckling of the thin sheet having low stiffness due to guide conveying resistance and the folding of the edge in frequently nipping the sheet between the rollers can be prevented to convey the sheet to the image forming portion.

In the first embodiment, the moving device moves sheet in the direction orthogonal to the sheet conveying direction based on the detection of the position at a side end of the sheet detected by CCDs 110 and 111. Alternatively, when a margin of the image forming width is ensured, the moving device is eliminated to shift the image write position in the bearing member based on the detection of the position at the side end of the sheet detected by CCDs 110 and 111, which allows the positions of the image and sheet S to be aligned with each other.

In the case of the thin sheet having low stiffness, sometimes an excessively strong suction force generates a wrinkle in the sheet to decrease the accuracy of the skew correction, when the conveying suction belts 101*a* and 101*b* are moved while reversing each other. However, when the suction force is set according to the thin sheet, the shortage of the suction force is caused for the thick sheet to generate sheet feeding failure. Therefore, in the first embodiment, the suction force is adjusted by changing a fan voltage according to pieces of information such as a sheet material, a basis weight, and a size by the user input or automatic detection.

Thus, the sheet feeding is performed after the sheet attitude is completely determined, which allows the sheet and the image to be accurately aligned with each other even in the thin sheet having low stiffness.

Figure 11:
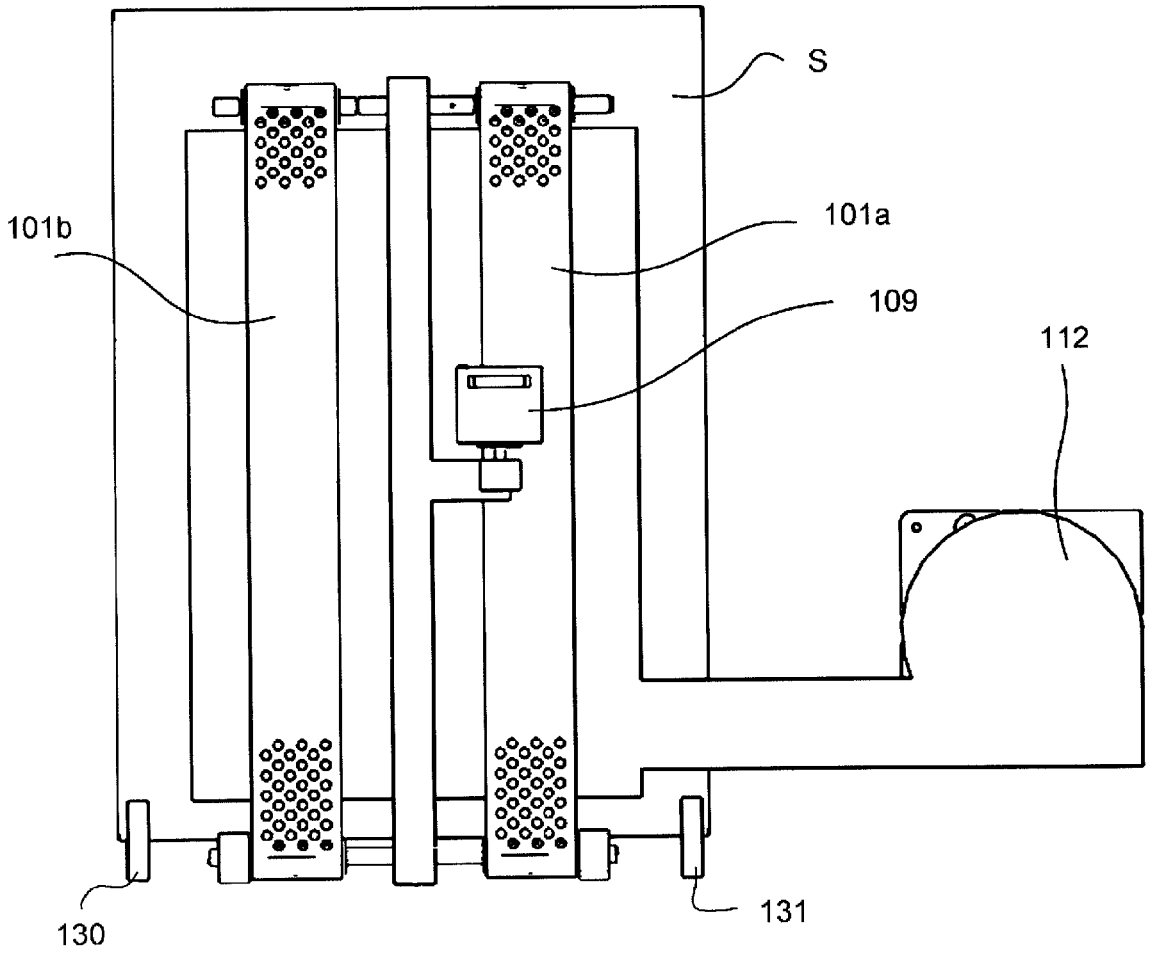
FIG. 11 is a perspective view showing a sheet feeding apparatus in which CCDs are transversely disposed.

In the first embodiment, CCDs 110 and 111 are disposed in the sheet conveying direction to detect the attitude of the sheet S. Alternatively, as shown in FIG. 11, CCDs 130 and 131 may be disposed in the direction orthogonal to the sheet conveying direction. CCD can be fixed when CCD has a length provided for all the different sizes of the sheets. However, when the short CCD is used, CCD may be configured to be movable according to the size of the sheet.

In the control of the first embodiment, the conveying suction belts 101*a* and 101*b* are rotated while reversing each other, thereby correcting the sheet skew. Alternatively, a difference in sheet conveying speed is generated between the conveying suction belts 101*a* and 101*b*, and the sheet may be rotated to correct the skew. In this case, it is necessary that the skew of the sheet be corrected until the sheet reaches the pair of conveying rollers 13*a* and 13*b* provided on the downstream side.

Second Embodiment

Figure 12:
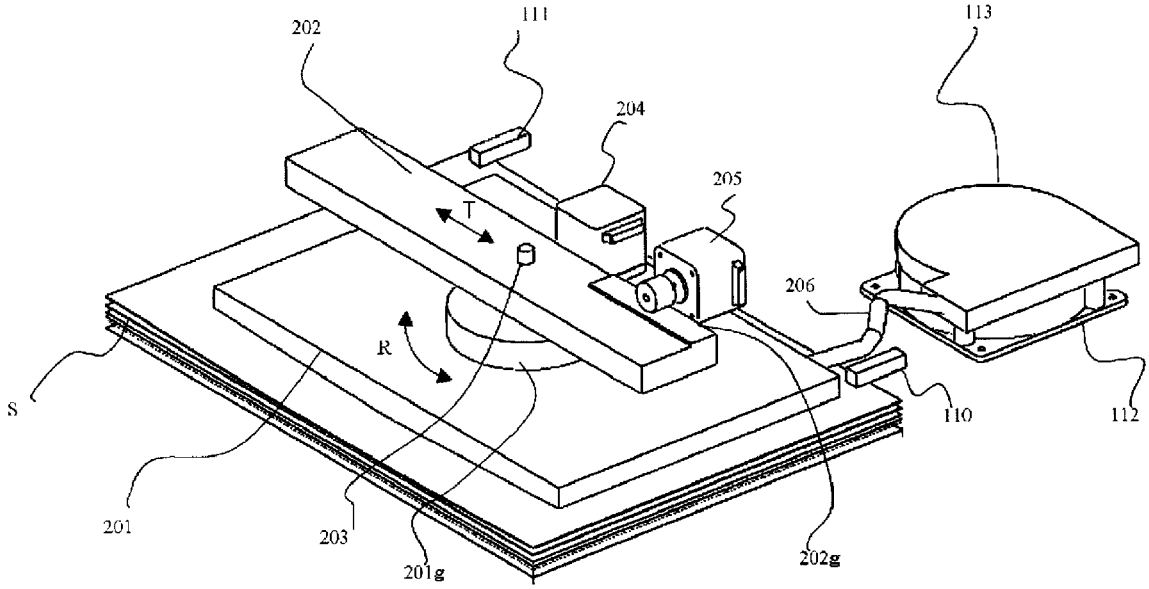
FIG. 12 is a perspective view showing an entire image forming apparatus according to a second embodiment of the invention.

An image forming apparatus according to a second embodiment of the invention will be described below with reference to FIG. 12. Because the image forming apparatus of the second embodiment has the same basic configuration as the first embodiment, the overlapped description is neglected, and only the configuration which becomes the feature of the second embodiment will be described. In FIG. 12, the component having the same function as the first embodiment is designated by the same numeral.

In the second embodiment, the suction head is movably formed to control the sheet attitude instead of the conveying suction belts 101*a* and 101*b* of the first embodiment. In a suction head 201 of FIG. 12, many suction holes are made in the whole surface brought into contact with the sheet S, and a rubber layer is bonded to enhance friction with the sheet S.

The suction fan 112 sucks the sheet S through the duct 113 and a flexible tube 206 using the suction head 201. The suction head 201 is projected toward the downward direction orthogonal to the sheet conveying direction. Therefore, as described in the first embodiment, the ganging at the side end of the sheet S is prevented to improve the detection accuracy with CCDs 110 and 111. The suction is performed in the central portion closest to the upper surface of the sheet, so that the wrinkle is not generated in the sheet during the suction.

The suction head 201 is supported while being rotatable in the direction of an arrow R about a pivot 203 of a stay 202, and the suction head 201 is rotated and moved by driving a gear portion 201*g* provided on the suction head 201 using a head rotating motor 204 which is of the stepping motor. Similarly to the first embodiment, the rotation amount and the moving amount are adjusted according to the correction amount detected by CCDs 110 and 111.

A rack 202*g* is provided in the stay 202, the rack 202*g* can be moved in the direction shown by an arrow T using a conveying slide motor 205 which is of the stepping motor, and the sheet adsorbed to the suction head 201 is fed to the conveying rollers 13*a* and 13*b* (see FIG. 1) by reciprocating the rack 202*g*.

Accordingly, similar to the first embodiment, the sheet is fed after the sheet attitude is determined, which allows the sheet and the image to be accurately aligned with each other even in the thin sheet having low stiffness.

This application claims the benefit of priority from the prior Japanese Patent Application No. 2006-308799 filed on Nov. 15, 2006 the entire contents of which are incorporated by reference herein.

What is claimed is:

1. A sheet feeding apparatus comprising:

a sheet supporting portion configured to support the sheets;

a sheet conveying device disposed above the sheet supporting portion configured to absorb and to convey the sheet;

a suction device configured to absorb the sheet from the sheet supporting portion to the sheet conveying device; and a detection device configured to detect a skew of the sheet adsorbed to the sheet conveying device by the suction device, wherein the sheet conveying device has two rotatable endless belts, disposed in a direction orthogonal to a sheet conveying direction, which absorbs and conveys the sheet, and the endless belts are rotated in directions reverse to each other based on the detection of the detection device, thereby rotating the sheet to correct the skew of the sheet.

2. The sheet feeding apparatus according to claim 1, wherein the sheet conveying device rotates the sheet in a plane including an adsorption surface of the sheet conveying device in a stopping state of a conveying function by the sheet conveying device.

3. The sheet feeding apparatus according to claim 2, wherein the detection device is disposed to detect an end portion of the sheet absorbed to the endless belts in the direction orthogonal to a sheet conveying direction.

4. The sheet feeding apparatus according to claim 1, wherein a central portion of the adsorption surface of the sheet conveying device is projected downward more than both end portions in the sheet conveying direction.

5. The sheet feeding apparatus according to claim 1, wherein the suction device is a fan and the fan is controlled such that an adsorption force to absorb the sheet to the sheet conveying device is adjusted according to a kind of the sheet to be fed.

6. The sheet feeding apparatus according to claim 1, further comprises a position detection device configured to detect the position of the sheet in a direction orthogonal to a conveying direction of the sheet, and a moving device configured to move the sheet conveying device in the direction orthogonal to the sheet conveying direction based on the detection of the position detection device.

7. An image forming apparatus which includes an image forming portion forming an image on a sheet fed from a sheet feeding apparatus, the image forming apparatus comprising:

a sheet supporting portion configured to support the sheets;

a sheet conveying device disposed above the sheet supporting portion configured to absorb and to convey the sheet toward the image forming portion;

a suction device configured to absorb the sheet from the sheet supporting portion to the sheet conveying device; and a detection device configured to detect a skew of the sheet adsorbed to the sheet conveying device by the suction device, wherein the sheet conveying device has two rotatable endless belts, disposed in a direction orthogonal to a sheet conveying direction, which absorbs and conveys the sheet, and the endless belts are rotated in directions reverse to each other based on the detection of the detection device, thereby rotating the sheet to correct the skew of the sheet.

8. The image forming apparatus according to claim 7, wherein the sheet conveying device rotates the sheet in a plane including an adsorption surface of the sheet conveying device in a stopping state of a conveying function by the sheet conveying device.

9. The image forming apparatus according to claim 7, further comprising:

a image bearing member configured to bear an image; and a transfer device configured to transfer the image on the image bearing member to the sheet.

10. The image forming apparatus according to claim 7, further comprising a front-end detection device configured to detect a front end of the sheet in the conveying direction on the sheet conveying belt, wherein image forming timing which the image is formed to the image bearing member is controlled based on detection of the front-end detection device.

11. The image forming apparatus according to claim 7, further comprising a side-end detection device configured to detect an end of the sheet in a direction orthogonal to a conveying direction of the sheet on the sheet conveying belt, wherein a write position of the image on the image bearing member is controlled such that an image position is aligned with the sheet based on a detection of the side-end detection device.

12. The image forming apparatus according to claim 7, further comprises a position detection device configured to detect the position of the sheet in a direction orthogonal to a conveying direction of the sheet, and a moving device configured to move the sheet conveying device in the direction orthogonal to the sheet conveying direction based on the detection of the position detection device.

* * * * *